US010431932B1

(12) United States Patent
Zhang et al.

(10) Patent No.: US 10,431,932 B1
(45) Date of Patent: Oct. 1, 2019

(54) CONNECTOR ASSEMBLY WITH METAL HOUSING FOR CONNECTION BETWEEN FIRST AND SECOND CONNECTORS

(71) Applicant: LUXSHARE PRECISION INDUSTRY Co., Ltd., Shenzhen (CN)

(72) Inventors: Frank Zhang, Shenzhen (CN); Bin Huang, Shenzhen (CN); Feng Pan, Shenzhen (CN); Kun-Lin Yao, Shenzhen (CN)

(73) Assignee: LUXSHARE PRECISION INDUSTRY CO., LTD., Shenzhen (CN)

( * ) Notice: Subject to any disclaimer, the term of this patent is extended or adjusted under 35 U.S.C. 154(b) by 0 days.

(21) Appl. No.: 15/951,386

(22) Filed: Apr. 12, 2018

(51) Int. Cl.

| | |
|---|---|
| ***H01R 13/64*** | (2006.01) |
| ***H01R 13/6594*** | (2011.01) |
| ***H01R 13/6581*** | (2011.01) |
| ***H01R 13/502*** | (2006.01) |
| ***H01R 12/72*** | (2011.01) |
| *H01R 12/71* | (2011.01) |

(52) U.S. Cl.
CPC ..... *H01R 13/64* (2013.01); *H01R 12/724* (2013.01); *H01R 13/502* (2013.01); *H01R 13/6581* (2013.01); *H01R 13/6594* (2013.01); *H01R 12/716* (2013.01)

(58) Field of Classification Search
CPC .... H01R 13/64; H01R 12/724; H01R 13/502; H01R 13/6594; H01R 13/6581; H01R 12/716; H01R 13/659; H01R 13/6586
USPC ..... 439/374, 638, 607.23–607.25
See application file for complete search history.

(56) References Cited

U.S. PATENT DOCUMENTS

| | | | | |
|---|---|---|---|---|
| 6,685,511 | B2 * | 2/2004 | Akama | H01R 12/62 439/607.46 |
| 7,131,862 | B2 * | 11/2006 | Vermeersch | H01R 13/6658 439/497 |
| 9,431,781 | B2 * | 8/2016 | Kuang | H01R 13/6586 |
| 2013/0237092 | A1 * | 9/2013 | Rubens | H01R 13/6596 439/607.23 |
| 2016/0043509 | A1 * | 2/2016 | Reeves | H01R 13/631 439/374 |

* cited by examiner

*Primary Examiner* — Travis S Chambers
(74) *Attorney, Agent, or Firm* — Birch, Stewart, Kolasch & Birch, LLP

(57) ABSTRACT

A connector assembly includes a first connector, a second connector and a metal housing. The first connector includes an insulating body, conductive terminals, and a first cable, each conductive terminal having a contact portion. The second connector includes a sub-circuit board and a second cable connected to the sub-circuit board, the sub-circuit board having a butting end facing the first connector, and gold fingers being distributed on the surface of the butting end. The metal housing is provided with an insertion hole, the insertion hole having a front insertion opening at the front end of the metal housing and a rear insertion opening at the rear end of the metal housing. The first connector is inserted into the insertion hole from the front insertion opening, and the second connector is inserted into the insertion hole from the rear insertion opening. The contact portions are in contact with the gold fingers.

10 Claims, 7 Drawing Sheets

CONNECTOR ASSEMBLY WITH METAL HOUSING FOR CONNECTION BETWEEN FIRST AND SECOND CONNECTORS

BACKGROUND

Technical Field

The present invention relates to a connector assembly, and particularly to a connector assembly having a plurality of butted connectors.

Related Art

Please refer to FIG. 7. In the prior art, a connector assembly 200 generally includes a board-side connector 201 and two plug connectors 202, 203. The board-side connector 201 is fixedly soldered to a circuit board (not shown). The board-side connector 201 includes an insulating body 204, a plurality of connecting terminals 205 received in the insulating body 204, and a metal shell 206 coating the insulating body 204. The front and rear ends of the insulating body 204 are provided with an insertion hole 207 separately. The connecting terminals 205 extend into the two insertion holes 207. After the two plug connectors 202, 203 are inserted into the corresponding insertion holes 207, they are mechanically and electrically connected to the connecting terminals 205, respectively, so that the two plug connectors 202, 203 are electrically communicated through the connecting terminals 205.

SUMMARY

An object of the present invention is to provide a connector assembly, of which the production cost can be reduced.

To achieve the foregoing object, the present invention adopts the following technical solution: a connector assembly includes a first connector, a second connector and a metal housing, wherein the first connector includes an insulating body, conductive terminals received in the insulating body, and a first cable extending backwards out of the insulating body, each conductive terminal has a contact portion, and the first cable is electrically connected to the conductive terminals; the second connector includes a sub-circuit board and a second cable electrically connected to the sub-circuit board, the sub-circuit board has a butting end facing the first connector, and gold fingers are distributed on the surface of the butting end; the metal housing is provided with an insertion hole, the insertion hole has a front insertion opening at the front end of the metal housing and a rear insertion opening at the rear end of the metal housing, the first connector is inserted into the insertion hole from the front insertion opening, and the second connector is inserted into the insertion hole from the rear insertion opening; and the contact portions are in contact with the gold fingers.

As a further improvement of the present invention, the first connector is a wire-end female socket, and the second connector is a wire-end male plug.

As a further improvement of the present invention, the insulating body is provided with a butting hole allowing insertion of the butting end, the contact portion extending into the butting hole.

As a further improvement of the present invention, the second connector further includes a metal shell receiving the sub-circuit board, the metal shell is provided with a receiving hole, the second cable extends out of the metal shell, and the insulating body is provided with a butting portion inserted into the insertion hole.

As a further improvement of the present invention, the metal shell includes a top plate, a bottom plate and left and right side plates, surrounding the exterior of the receiving hole, the two side plates connecting the top plate and the bottom plate.

As a further improvement of the present invention, the metal housing is of a front-hollow and rear-hollow housing structure, and includes a top wall, a bottom wall, and two side walls connecting the top wall and the bottom wall, the insertion hole being formed between the top wall, the bottom wall and the two side walls.

As a further improvement of the present invention, the metal housing is provided with a horizontal partition located in the front insertion opening, for guiding insertion of the first connector.

As a further improvement of the present invention, the contact portions are of an arc-shaped structure, and are distributed in the butting hole in an upper row and a lower row.

As a further improvement of the present invention, a plurality of fixing pieces for fixing to a circuit board extends downwards from the metal shell.

As a further improvement of the present invention, the sub-circuit board is replaced with a conductive terminal in contact with the conductive terminal of the first connector.

In the case where a connecting terminal is not required in a metal housing of the connector assembly of the present invention, first and second connectors are directly butted together, thereby reducing signal attenuation and the production cost of the connector assembly. The metal housing may guide and maintain reliable butting between the first and second connectors. The metal housing may be used to fix the first and second connectors to predetermined positions. The metal housing is located outside the first and second connectors, and may provide a function of signal shielding.

DETAILED DESCRIPTION

Figure 1:
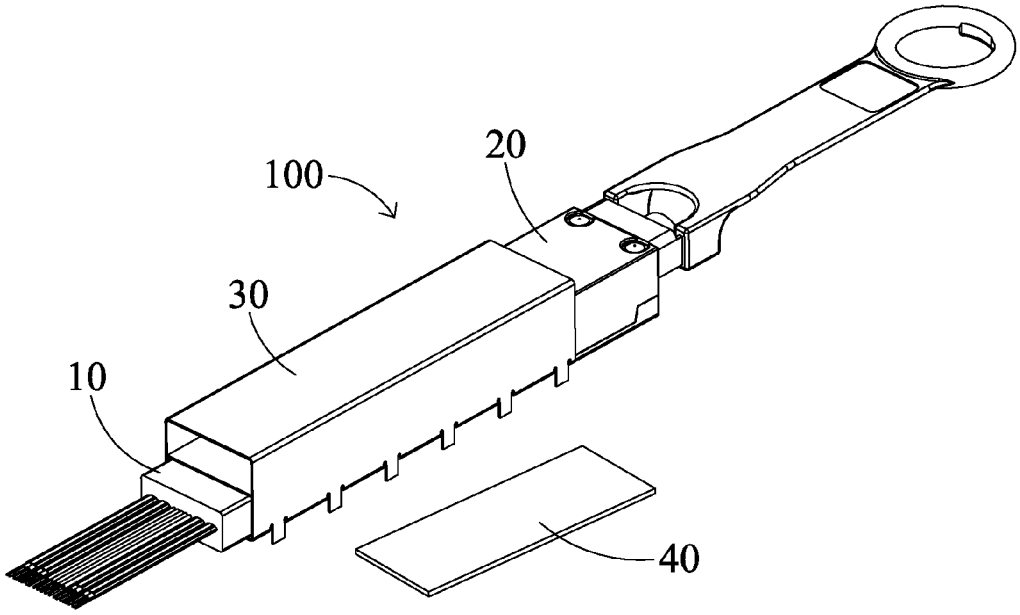
FIG. 1 is a three-dimensional schematic diagram of a connector assembly and a circuit board according to the present invention.
Figure 2:
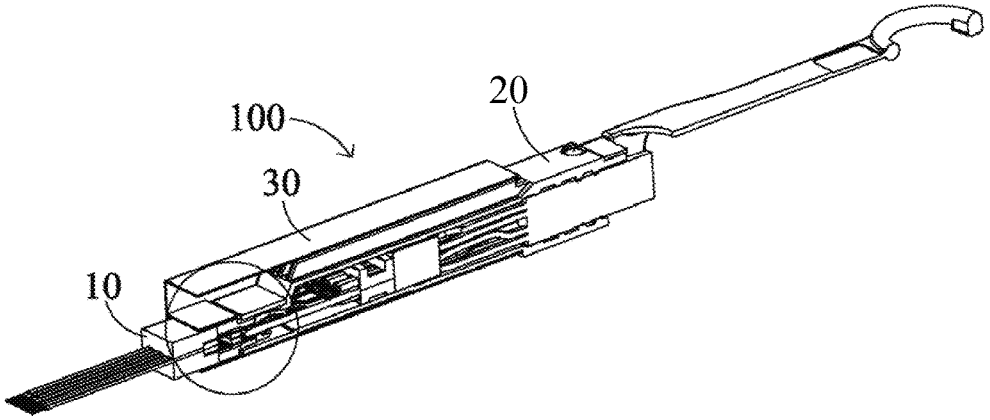
FIG. 2 is a sectional view of a connector assembly according to the present invention.
Figure 3:
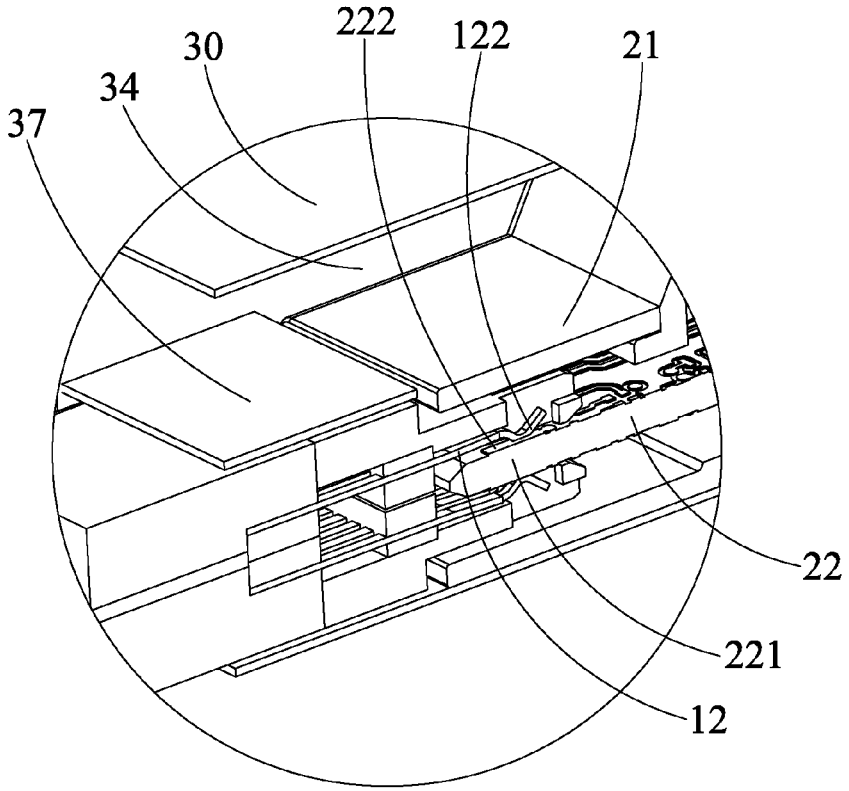
FIG. 3 is an enlarged view of components in a circle in FIG. 2.
Figure 4:
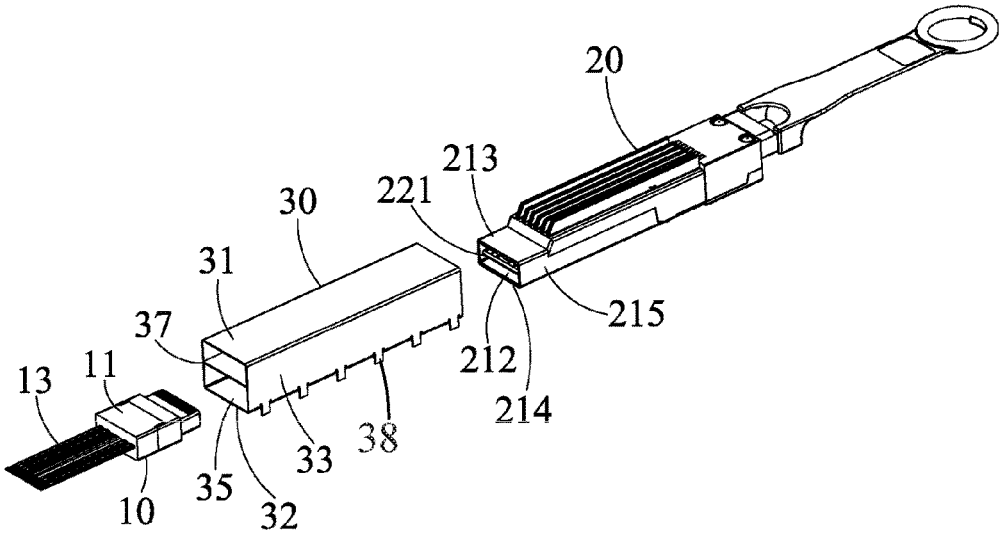
FIG. 4 is a three-dimensional exploded view of a connector assembly according to the present invention.
Figure 5:
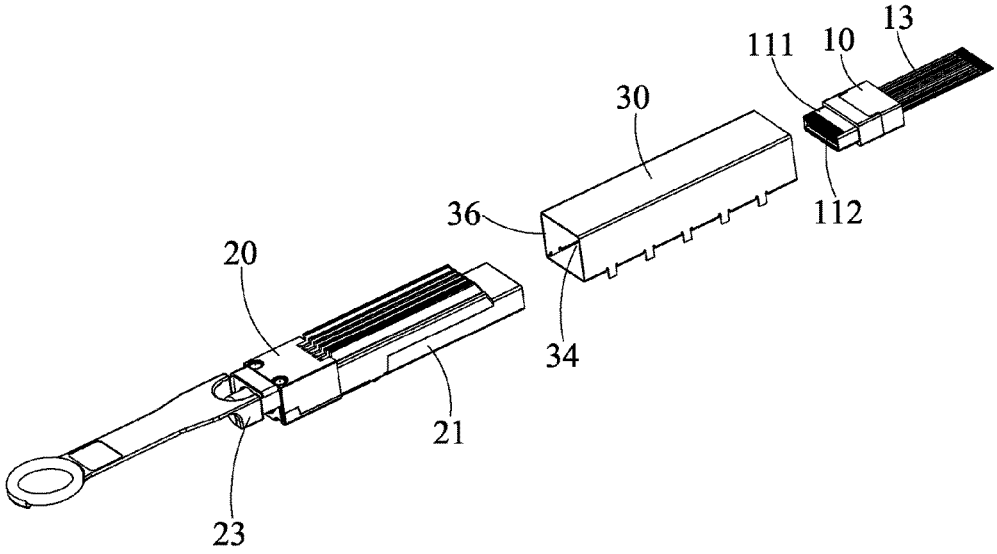
FIG. 5 is a three-dimensional exploded view of a connector assembly from another perspective according to the present invention.
Figure 6:
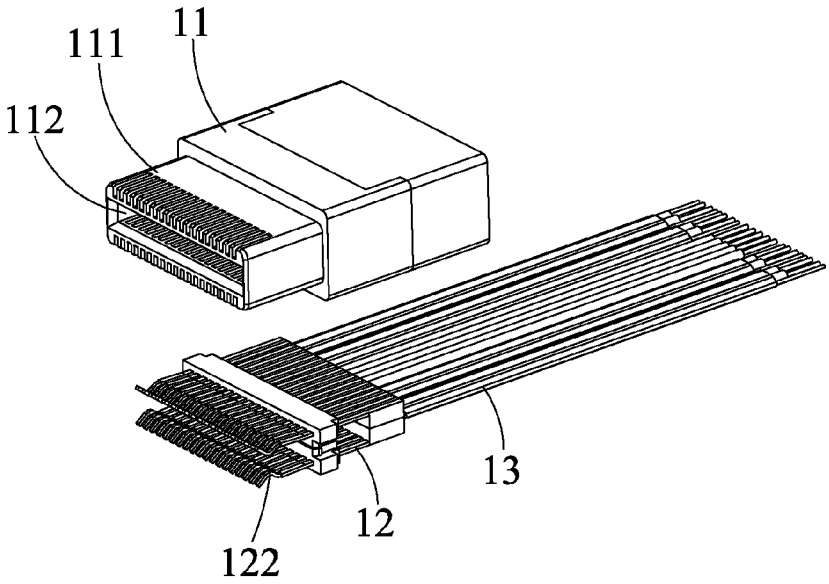
FIG. 6 is a three-dimensional exploded view of a first connector of a connector assembly according to the present invention.
Figure 7:
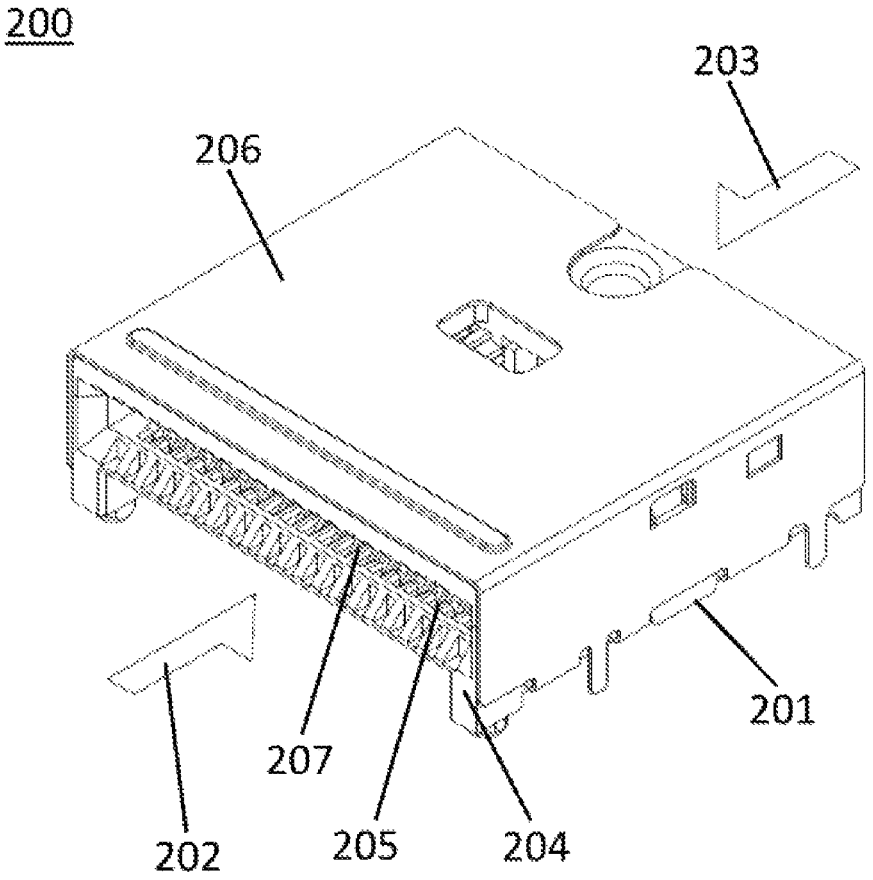
FIG. 7 (Prior Art)
FIG. 7 is a three-dimensional schematic diagram of a connector assembly in the prior art.

As shown in FIG. 1 to FIG. 7, a connector assembly 100 of the present invention includes a first connector 10, a second connector 20, and a metal housing 30 fixed to a circuit board 40.

The first connector 10 is a wire-end female socket, including an insulating body 11, a plurality of conductive terminals 12 received in the insulating body 11, and a first cable 13 electrically connected to the conductive terminals 12, the insulating body 11 has a butting portion 111 protruding towards the second connector 20 and a butting hole 112 provided on the butting portion 111, the conductive terminal 12 has an arc-shaped contact portion 122 located in the butting hole 112, the contact portions 122 are symmetrically arranged up and down in two rows, and the first cable 13 extends out of the insulating body 11.

The second connector 20 is a wire-end male plug, including a metal shell 21, a sub-circuit board 22 received in the metal shell 21, and a second cable 23 electrically connected to the sub-circuit board 22, the metal shell 21 is provided with a receiving hole 212 as well as a top plate 213, a bottom plate 214 and left and right side plates 215 surrounding the exterior of the receiving hole 212, and the two side plates 215 connect the top plate 213 and the bottom plate 214. The sub-circuit board 22 has a butting end 221 located in the receiving hole 212, a plurality of gold fingers 222 are distributed on the upper and lower surfaces of the butting end 221, and the second cable 23 extends out of the metal shell 21.

The metal housing 30 is of a front-hollow and rear-hollow housing structure, and includes a top wall 31, a bottom wall 32, two side walls 33 connecting the top wall 31 and the bottom wall 32, and an insertion hole 34 located therebetween, the insertion hole 34 has a front insertion opening 35 and a rear insertion opening 36 at the front and rear ends of the metal housing 30, and a horizontal partition 37 is disposed in the front insertion opening 35 and used for guiding insertion of the first connector 10. The two side walls 33 have a plurality of fixing pieces 38 extending downwards, for fixing to the circuit board 40.

When the metal housing 30 is butted with the first connector 10 and the second connector 20, the first connector 10 is inserted into the insertion hole 34 from the front insertion opening 35, the second connector 20 is inserted into the insertion hole 34 from the rear insertion opening 36, the butting portion 111 of the insulating body 11 of the first connector 10 is inserted into the receiving hole 212 of the metal shell 21 of the second connector 20, the butting end 221 of the sub-circuit board 22 enters the butting hole 112 of the insulating body 11 and is clamped by the contact portions 122 of the conductive terminals 12, and the gold fingers 222 are in contact with the contact portions 122, such that the first connector 10 and the second connector 20 are directly butted together and thus electrically conducted. In other embodiments, the sub-circuit board 22 is replaced with conductive terminals, which may also implement the foregoing function.

In the case where a connecting terminal is not required in the metal housing 30 of the connector assembly 100 of the present invention, the first connector 10 and the second connector 20 are directly butted together, thereby reducing signal attenuation and the production cost of the connector assembly 100. The metal housing 30 may guide and maintain reliable butting between the first connector 10 and the second connector 20. Since the metal housing 30 is fixed to the circuit board 40, it is convenient to fix the first connector 10 and the second connector 20 to predetermined positions. Since the metal housing 30 is located outside the first connector 10 and the second connector 20, a function of signal shielding is provided.

Although the preferred embodiments of the present invention have been disclosed for illustrative purposes, those of ordinary skill in the art will realize that various improvements, additions and replacements are possible without departing from the scope and spirit of the present invention as disclosed in the appended claims.

What is claimed is:

1. A connector assembly, comprising a first connector, a second connector and a metal housing, the first connector comprising an insulating body, conductive terminals received in the insulating body, and a first cable extending out of the insulating body, each conductive terminal having a contact portion, the first cable being electrically connected to the conductive terminals, the second connector comprising a sub-circuit board and a second cable electrically connected to the sub-circuit board, the sub-circuit board having a butting end facing the first connector, and gold fingers being distributed on the surface of the butting end, wherein the metal housing is fixed to a circuit board and provided with an insertion hole, the insertion hole has a front insertion opening at the front end of the metal housing and a rear insertion opening at the rear end of the metal housing, the first connector is detachably inserted into the insertion hole from the front insertion opening, the second connector is detachably inserted into the insertion hole from the rear insertion opening, and the contact portions are in contact with the gold fingers.

2. The connector assembly according to claim 1, wherein the first connector is a wire-end female socket, and the second connector is a wire-end male plug.

3. The connector assembly according to claim 1, wherein the insulating body is provided with a butting hole allowing insertion of the butting end, and the contact portion extends into the butting hole.

4. The connector assembly according to claim 1, wherein the metal housing is of a front-hollow and rear-hollow housing structure, and comprises a top wall, a bottom wall, and two side walls connecting the top wall and the bottom wall, and the insertion hole is formed between the top wall, the bottom wall and the two side walls.

5. The connector assembly according to claim 1, wherein the metal housing is provided with a horizontal partition located in the front insertion opening, for guiding insertion of the first connector.

6. The connector assembly according to claim 1, wherein the contact portions are of an arc-shaped structure, and are distributed in a butting hole of the insulating body in an upper row and a lower row.

7. The connector assembly according to claim 1, wherein a plurality of fixing pieces for fixing to a circuit board extends downwards from the metal housing.

8. The connector assembly according to claim 1, wherein the sub-circuit board is replaced with conductive terminals in contact with the conductive terminals of the first connector.

9. The connector assembly according to claim 1, wherein the second connector also comprises a metal shell receiving the sub-circuit board, the metal shell is provided with a receiving hole, the second cable extends out of the metal shell, and the insulating body is provided with a butting portion inserted into the insertion hole.

10. The connector assembly according to claim 9, wherein the metal shell comprises a top plate, a bottom plate and left and right side plates, surrounding the exterior of the receiving hole, and the left and right side plates connects the top plate and the bottom plate.

* * * * *